US010491983B2

(12) United States Patent
Oh et al.

(10) Patent No.: US 10,491,983 B2
(45) Date of Patent: Nov. 26, 2019

(54) PORTABLE SOUND EQUIPMENT

(71) Applicant: LG ELECTRONICS INC., Seoul (KR)

(72) Inventors: Hyunseok Oh, Seoul (KR); Donghyun Kim, Seoul (KR); Yunjin Choi, Seoul (KR); Seunghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 31 days.

(21) Appl. No.: 15/861,366

(22) Filed: Jan. 3, 2018

(65) Prior Publication Data

US 2018/0192181 A1 Jul. 5, 2018

Related U.S. Application Data

(60) Provisional application No. 62/442,365, filed on Jan. 4, 2017.

(30) Foreign Application Priority Data

Feb. 15, 2017 (KR) ..... 10-2017-0020723

(51) Int. Cl.

| | |
|---|---|
| ***H04R 1/00*** | (2006.01) |
| ***H04R 1/10*** | (2006.01) |
| ***H04R 1/08*** | (2006.01) |

(52) U.S. Cl.

CPC ..... *H04R 1/1066* (2013.01); *H04R 1/083* (2013.01); *H04R 1/105* (2013.01); *H04R 1/1016* (2013.01); *H04R 2420/07* (2013.01)

(58) Field of Classification Search

CPC ..... H04R 1/105; H04R 1/1033; H04R 1/1075

See application file for complete search history.

(56) References Cited

U.S. PATENT DOCUMENTS

| | | | | |
|---|---|---|---|---|
| 10,080,075 | B2 * | 9/2018 | Kang | G01R 33/02 |
| 2014/0211959 | A1 * | 7/2014 | Boyajian | H04R 1/1041 381/74 |
| 2015/0264474 | A1 * | 9/2015 | Seo | G06F 3/165 381/74 |
| 2015/0365755 | A1 * | 12/2015 | Harper | H04R 1/1033 381/384 |

(Continued)

FOREIGN PATENT DOCUMENTS

| | | | |
|---|---|---|---|
| KR | 10-1218107 | B1 | 1/2013 |
| KR | 10-1521938 | B1 | 5/2015 |
| KR | 10-1687623 | B1 | 12/2016 |

*Primary Examiner* — Matthew A Eason

(74) *Attorney, Agent, or Firm* — Birch, Stewart, Kolasch & Birch, LLP

(57) ABSTRACT

A portable sound apparatus including a body wearable on a user's body, an ear bud holder formed on the body, the ear bud holder being closed on one side and having an opening on an opposite side, an ear bud having one side inserted into the ear bud holder and an opposite side exposed through the opening of the ear bud holder, and a first magnet positioned in the ear bud holder is provided. The ear bud includes an ear bud housing having a sound hole on one side, an ear tip coupled to the sound hole and positioned within the ear bud holder when the ear bud is coupled to the ear bud holder, a receiver positioned inside the ear bud housing and configured to output sound through the sound hole, and a second magnet having an opposite polarity to the first magnet.

19 Claims, 14 Drawing Sheets

(56) References Cited

U.S. PATENT DOCUMENTS

| | | | | |
|---|---|---|---|---|
| 2016/0050774 | A1* | 2/2016 | Merenda | H05K 5/0086<br>224/162 |
| 2016/0073188 | A1* | 3/2016 | Linden | H04R 1/1025<br>381/309 |
| 2016/0366506 | A1* | 12/2016 | Kim | H04R 1/1091 |
| 2017/0093079 | A1* | 3/2017 | Wagman | A45C 13/02 |

* cited by examiner

FIG. 4
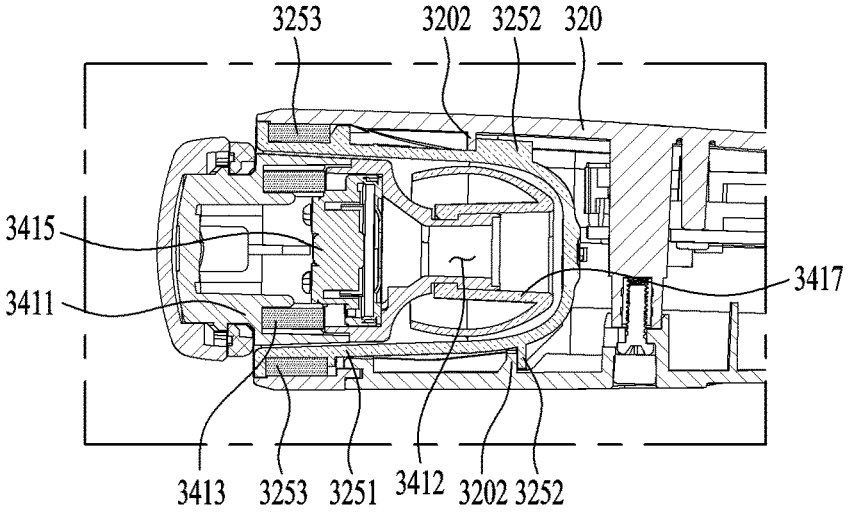
(a)
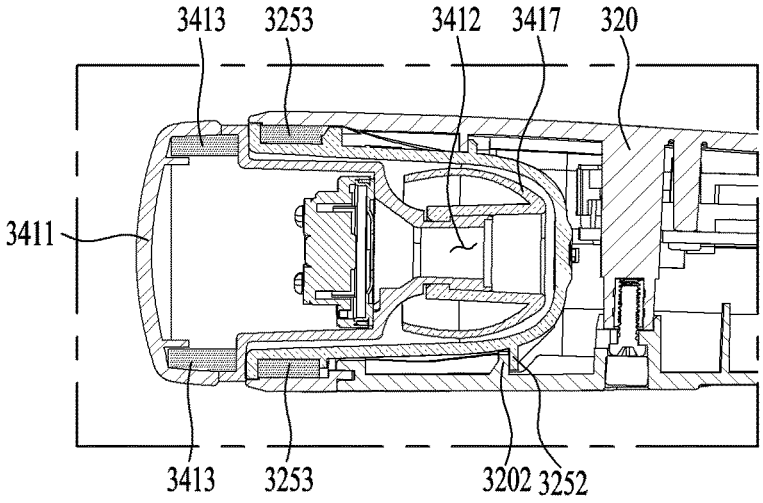
(b)

FIG. 5
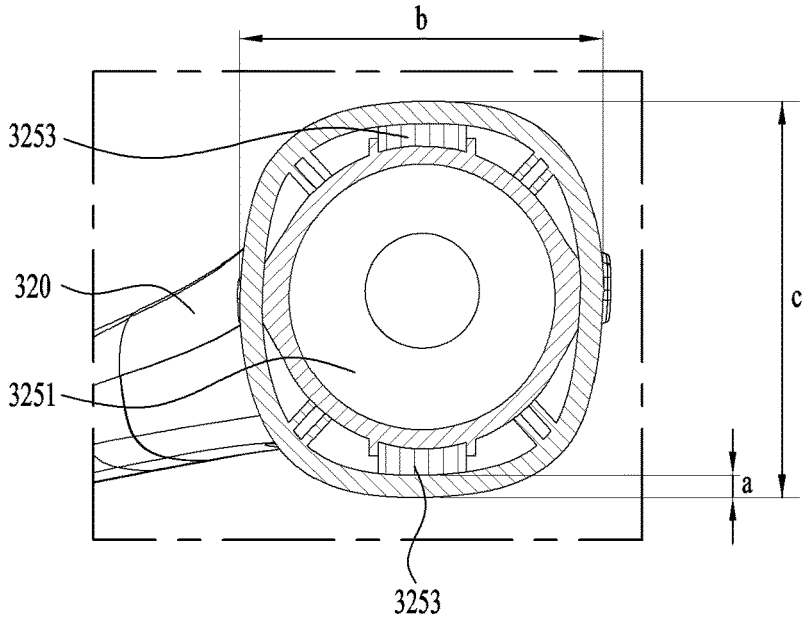
(a)
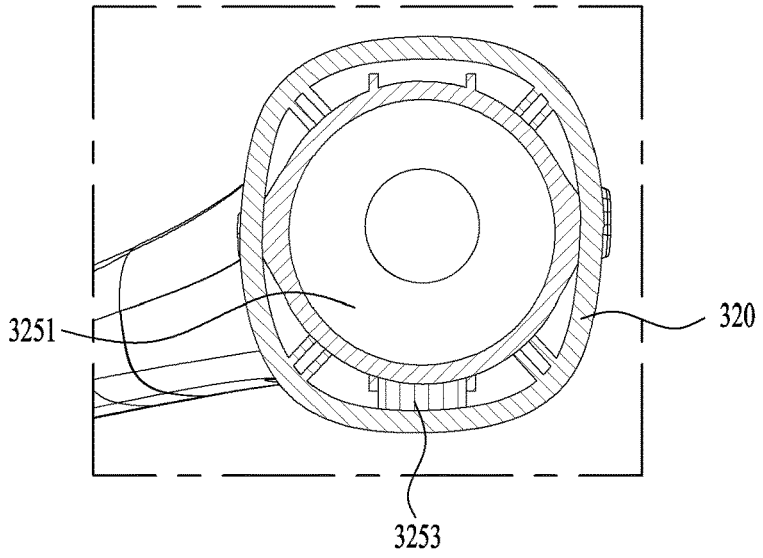
(b)

FIG. 6
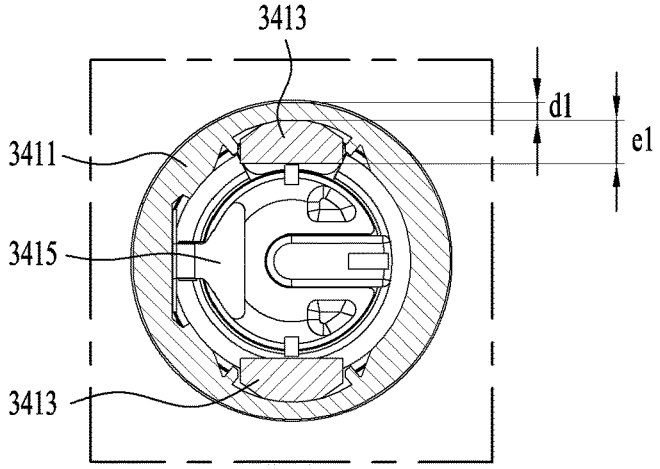
(a)
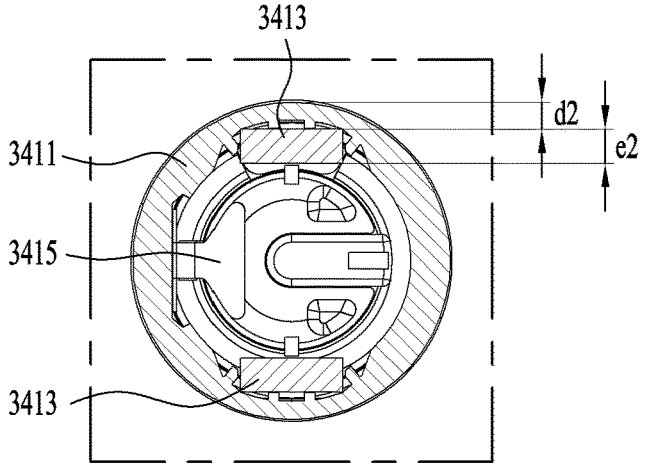
(b)

FIG. 7

| | First magnet (1) | Second magnet (1) | Second magnet (2) | First magnet (2) | Movement |
|---|---|---|---|---|---|
| Polarity | N | S | N | S | Pulling in the case of insertion of earphone in the forward direction. Pushing possible in the case of insertion of earphone in the 180-degree reverse direction |
| | N | S | S | N | Pulling in the case of insertion of earphone in both the forward and 180-degree reverse directions |

(a)

| | Second magnet (1) | Second magnet (2) | First magnet | Movement |
|---|---|---|---|---|
| Polarity | N | S | N | Pulling in the case of insertion of earphone in the forward direction. Pushing possible in the case of insertion of earphone in the 180-degree reverse direction |
| | N | N | S | Pulling in the case of insertion of earphone in both the forward and 180-degree reverse directions |

(b)

FIG. 8
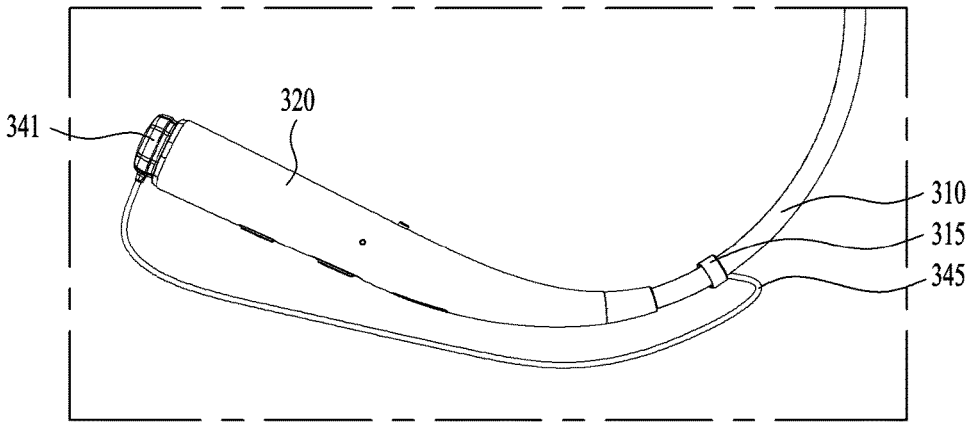
(a)
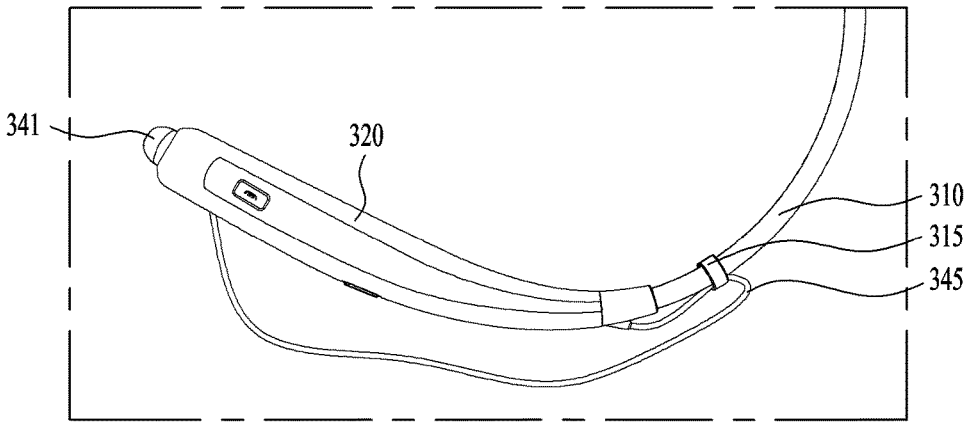
(b)

FIG. 11
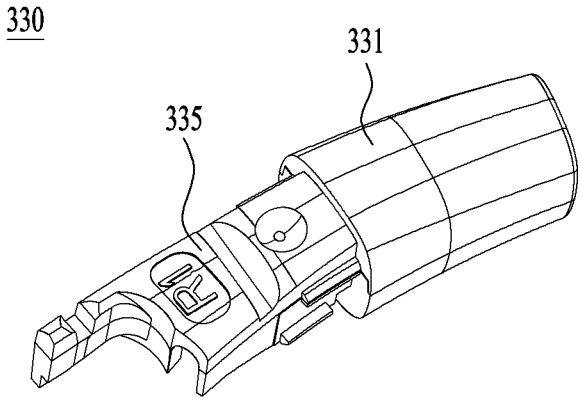
(a)
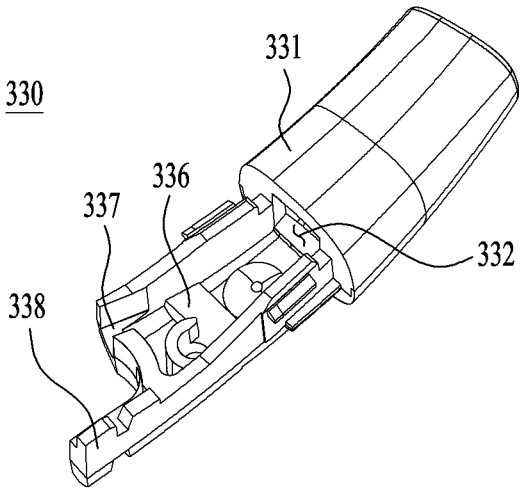
(b)

FIG. 12
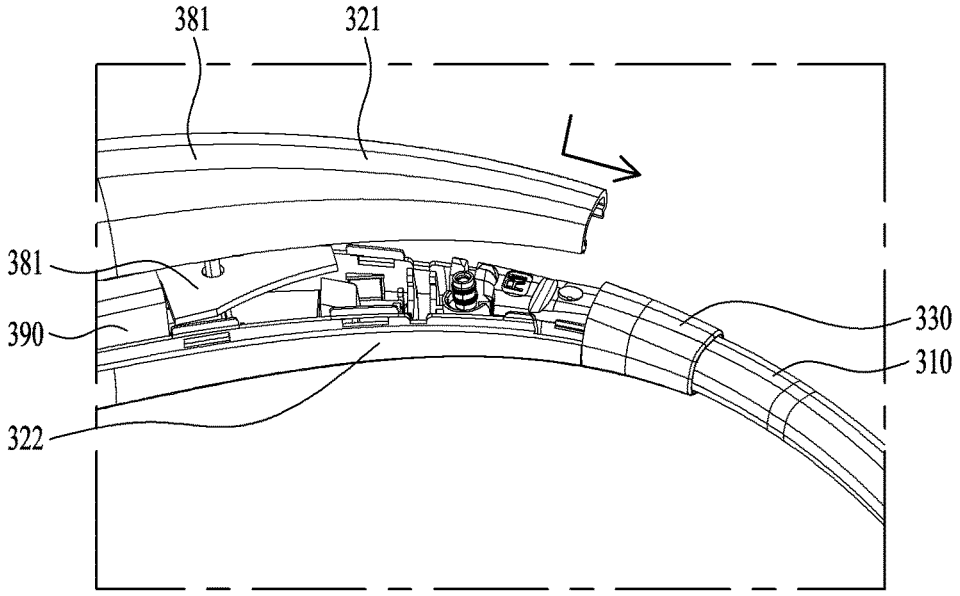
(a)
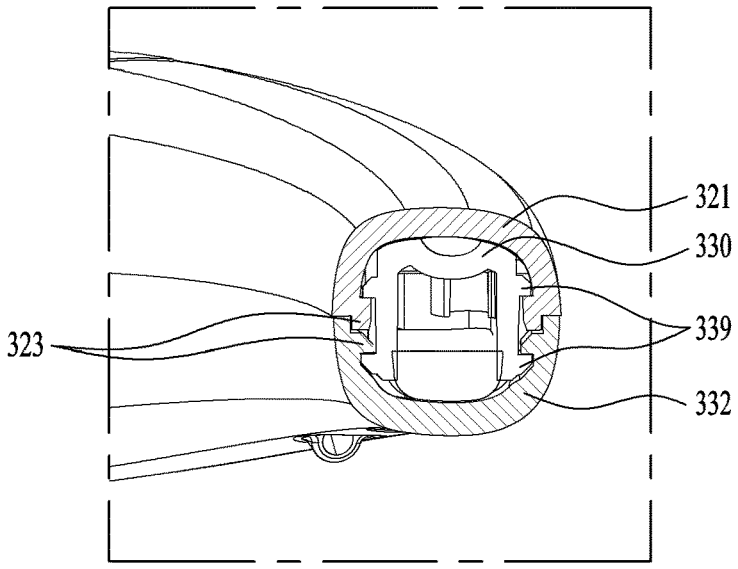
(b)

PORTABLE SOUND EQUIPMENT

CROSS-REFERENCE TO RELATED APPLICATIONS

This application claims priority to U.S. Provisional Application No. 62/442,365 filed on Jan. 4, 2017 and Korean Application No. 10-2017-0020723 filed on Feb. 15, 2017, the entire contents of all of which are hereby incorporated by reference in their entireties.

BACKGROUND OF THE INVENTION

Field of the Invention

The present invention relates to a portable sound apparatus having an ear bud which may be housed in a body that is worn around a user's neck.

Discussion of the Related Art

An electronic apparatus is a sound apparatus that receives a sound signal from a terminal and transmits sound information collected through a microphone to a terminal. Conventionally, a wired method is used to connect a terminal of the portable sound apparatus to an earphone jack of a terminal device to receive a sound signal. However, in view of mobility and ease of use, demand for a portable sound apparatus employing a wireless communication scheme is recently increasing.

There have been developed portable sound apparatuses designed to have portability, such as headphones type sound apparatus fitted onto a user's head in the shape of a band, an ear hanging type sound apparatus that is hung on the ears, and an ear inserting type sound apparatus that is inserted into the ears.

Among portable sound apparatuses having a body worn around the user's neck in consideration of portability, portable sound apparatuses having a body to which ear buds are detachably attached and inserted into the ears have become popular. However, for these portable sound apparatuses, a sound cable connecting the body and the ear buds is cumbersome or the ear tips of the ear buds may be contaminated as the sound apparatuses are carried with the ear tips exposed.

SUMMARY OF THE INVENTION

An object of the present invention is to provide a portable sound apparatus capable of preventing the ear tips from being exposed to the outside and ensuring that the sound cable is brought into close contact with the body and is not caught by a hand or clothing to be separated from the ear bud holder.

To achieve these objects and other advantages and in accordance with the purpose of the invention, as embodied and broadly described herein, a portable sound apparatus includes a body wearable on a user's body, an ear bud holder formed on the body, the ear bud holder being closed on one side and having an opening on an opposite side, an ear bud having one side inserted into the ear bud holder and an opposite side exposed through the opening of the ear bud holder, and a first magnet positioned in the ear bud holder, wherein the ear bud includes an ear bud housing having a sound hole on one side, an ear tip coupled to the sound hole and positioned within the ear bud holder when the ear bud is coupled to the ear bud holder, a receiver positioned inside the ear bud housing and configured to output sound through the sound hole, and a second magnet having an opposite polarity to the first magnet.

The first magnet may include one magnet positioned at a lower side of a periphery adjacent to the opening of the ear bud holder when the body is worn by the user.

The first magnet may include two magnets respectively positioned on an upper side and a lower side of a periphery adjacent to the opening of the ear bud holder when the body is worn by the user.

The ear bud holder may be positioned at an end of the body, wherein a cross section of the body may be longer in a vertical direction than in a transverse direction.

The ear bud housing may have a cylindrical shape, wherein corners of the second magnet facing an inner surface of the ear bud housing may be omitted.

The body may be wearable on the user's neck and have a first face contacting the user's body, the portable sound apparatus further including a sound cable having one end connected to an opposite side of the ear bud housing and an opposite end connected to the first face of the body.

The sound cable may be disposed in a direction perpendicular to the second magnet.

The portable sound apparatus may further include a groove having an inclined surface formed on the first face of the body, wherein the opposite end of the sound cable may be positioned in the groove and extends along the inclined surface.

The portable sound apparatus may further include a cable clip coupled between the one end and the opposite end of the sound cable and configured to fix the sound cable to the body, wherein the body may have a rectangular cross section with rounded corners, wherein the cable clip may include a first fixing portion configured to surround the body and having a ring shape corresponding to the cross section of the body, and a second fixing portion inserted into the first ring toward the first face of the body, the sound cable penetrating the second fixing portion.

The first fixing portion may be open in a direction perpendicular to a direction in which the second fixing portion is formed, and have a C-shape.

The body may include a band part positioned behind the user's neck and coupled with the cable clip, and a pair of housings provided at both ends of the band part and coupled to the opposite end of the sound cable.

The body may include a band part positioned behind the user's neck, a bracket coupled to an end of the band part, a slide guide protruding to the bracket, and a housing including a slide hook contacting the slide guide, wherein the housing may be slidably coupled to the bracket.

The portable sound apparatus may further include a signal line extending from the band part and having an end extending into the housing, and a waterproof ring positioned inside the housing and configured to surround a periphery of the signal line.

The portable sound apparatus according to the present invention may be carried without the ear tips being exposed to the outside, and accordingly, the ear tips may not be contaminated.

In addition, since a part between the housing and the cable clip is brought into close contact with the body, it may not be caught by the sound cable.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein:

FIG. 4 is a cross-sectional view showing an ear bud coupled to an ear bud holder of a portable sound apparatus according to an embodiment of the present invention, taken along line A-A of FIG. 2;

FIG. 5 is a cross-sectional view showing arrangement of a first magnet of the ear bud holder of the portable sound apparatus according to the embodiment of the present invention, taken along line B-B of FIG. 2;

FIG. 6 is a cross-sectional view showing arrangement of a second magnet of the ear bud of the portable sound apparatus according to the embodiment of the present invention, taken along line C-C of FIG. 2;

FIG. 7 is a table for describing operations that occur when an ear bud is coupled to an ear bud holder according to polarities of a first magnet and a second magnet of a portable sound apparatus according to an embodiment of the present invention;

FIG. 8 is a view illustrating coupling between the ear bud and the ear bud holder according to the present invention and the related art;

FIG. 11 shows a bracket of a portable sound apparatus of the present invention;

FIG. 12 illustrates coupling between a bracket and a housing of a portable sound apparatus of the present invention;

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
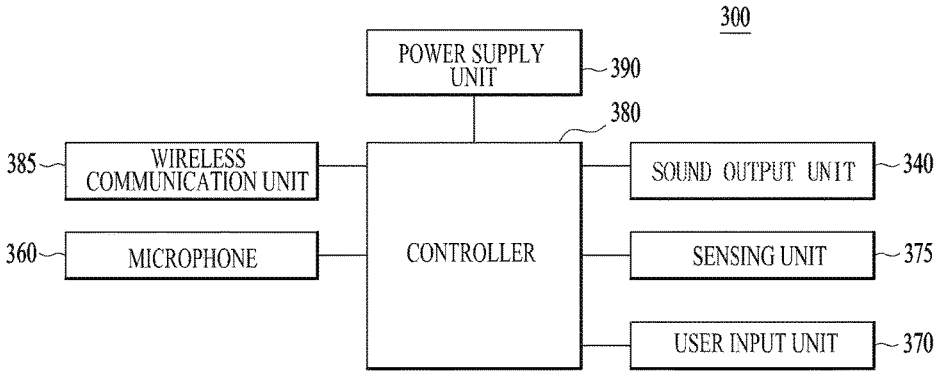
FIG. 1 is a block diagram illustrating configuration of a portable sound apparatus of the present invention.

FIG. 1 is a block diagram illustrating configuration of a portable sound apparatus 300 of the present invention. The portable sound apparatus 300 of the present invention includes a controller 380, a wireless communication unit 385, a sound output unit 340, a sensing unit 375, a microphone 360, a user input unit 370, and a power supply 390.

The sound output unit 340 is a device for outputting sound according to a sound signal. A typical example of the sound output unit is an ear bud 341 fitted into a user's ear to transmit sound.

The microphone 360 processes external sound signals into electrical voice data. The processed voice data is transmitted to an external terminal device or an external server through the wireless communication unit 385. In the microphone 360, various noise cancellation algorithms for canceling noise generated in receiving external sound signals may be implemented.

The sensing unit 375 is a device configured to recognize the state of the portable sound apparatus 300 and the situation of the surroundings, and may include an illuminance sensor for sensing brightness of the surroundings, a touch sensor for sensing touch input, a gyro sensor for sensing the tilt and position of the portable sound apparatus 300, and an ear bud switch for sensing whether or not the ear bud 341 is positioned in the ear bud holder 325.

The user input unit 370 is an input unit for a user to control the portable sound apparatus 300, and may include, for example, a call/playback button 371, a button for volume control, a power button, and an accommodation button for accommodating a sound cable 345 in the housing 320.

The user input unit 370 may include only a call button and a pair of volume control buttons, or may further include a play/stop button, and an order-of-songs change button. The size of the portable sound apparatus 300 is limited and the user provides input through the input unit 370 without visually checking the input in many cases. Accordingly, if the number of buttons provided is large, it may be difficult to distinguish between the functions of the respective buttons. Therefore, inputtable control commands may be extended by combinations of the duration of pressing buttons and the number of times of pressing of the buttons, and a plurality of buttons, using a limited number of buttons.

Since the portable sound apparatus 300 remains worn on the body of the user, there is a low risk of losing the portable sound apparatus 300. However, a normal terminal device may be lost. In this case, two user input units 370 may be pressed simultaneously for a certain time to make an alarm sound of the terminal device connected to the portable sound apparatus 300 through Bluetooth.

In addition, the voice recording function of the terminal device connected through Bluetooth may be activated to store the voice collected through the microphone 360 of the portable sound apparatus 300 in the terminal device.

In conventional cases, only a function related to calling or reproduction of sound media can be controlled by the portable sound apparatus 300. In contrast, the portable sound apparatus 300 of the present invention has an extended range of control.

Figure 2:
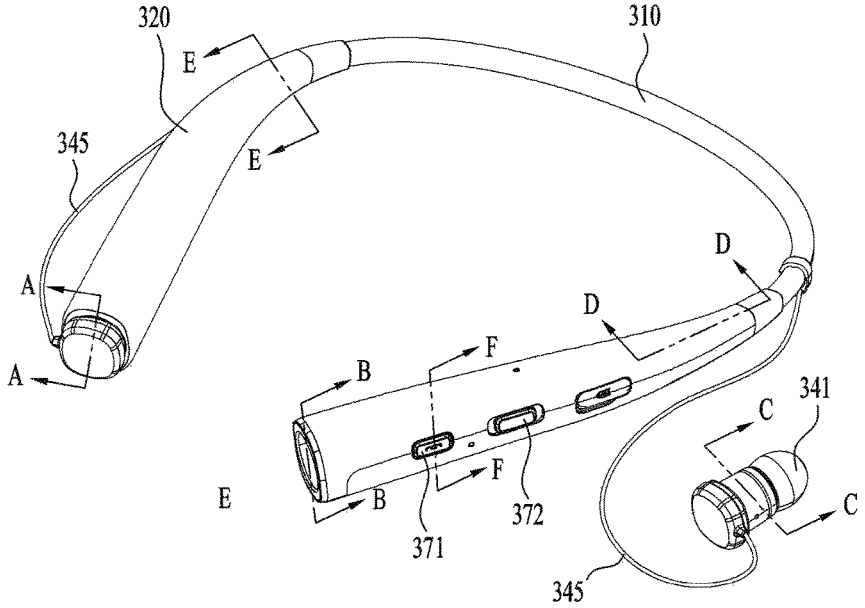
FIG. 2 is a perspective view of a portable sound apparatus according to an embodiment of the present invention, viewed in one direction.

FIG. 2 is a perspective view of a portable sound apparatus 300 according to an embodiment of the present invention, viewed in one direction. The body of the portable sound apparatus 300 of the present invention is wearable on the user's body. In particular, the body is formed in a C shape so as to be worn around the neck of the user, and may include a band part 310 and a housing 320.

The band part 310 is positioned on the back of the user's neck and is elastically deformable. Accordingly, the user can change the curvature of the band part 310 to wear the band part on their neck. A signal line may be extended in a longitudinal direction of the band part 310 to transmit signals and power through the housing 320 coupled to both ends of the band part 310.

To provide symmetrical shapes to both ends of the band part 310 coupled with the housing 320, a pair of housings 320 may be provided and coupled to both ends of the band part 310. The housings 320 may be equipped with different components. For example, a power supply 390 may be installed in the housing 320 on one side, and a main substrate 381 and a wireless communication unit 385 may be installed in the housing 320 on the other side.

Hereinafter, for simplicity, a part of the housing 320 which contacts the body of the user will be referred to as a lower portion, a part of the housing 320 that faces upward and does not contact the body of the user when worn by the user will be referred to as an upper portion, and a direction perpendicular to the vertical direction will be referred to as a transverse direction.

Figure 3:
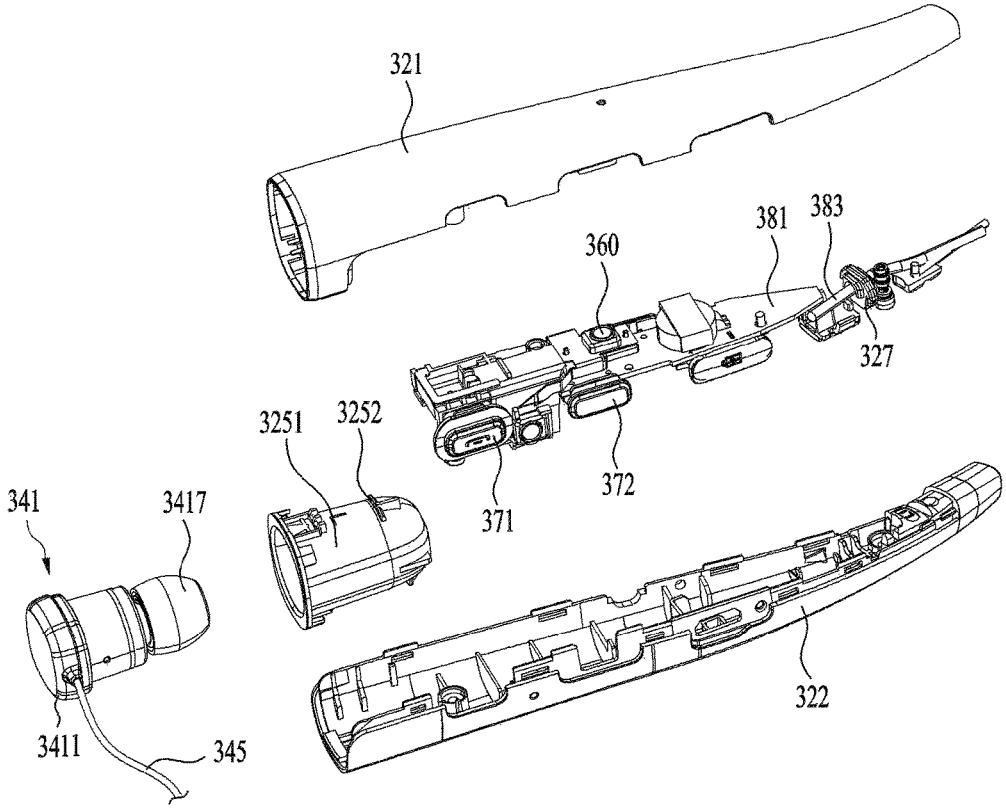
FIG. 3 is an exploded perspective view of a housing portion of a portable sound apparatus according to an embodiment of the present invention.

FIG. 3 is an exploded perspective view showing the housing 320 and components installed therein. Various electronic components such as a main board 381, a battery, and a wireless communication unit may be installed in the housing. The housing 320 may include a rigid material (e.g., an injection molded article or a metal material). As an upper housing 321 and a lower housing 322 are coupled to each other, an inner space may be defined therebetween.

The user input unit 370 exposed to the outside of the housing 320 may control the portable sound apparatus 300 or an external terminal connected through the wireless communication unit 385 of the portable sound apparatus 300. The user input unit 370 may be selected from among a button type for inputting a signal by pushing, a slide type for inputting a signal through sliding, a switch type for selecting one of two states such as ON/OFF, a wheel type for controlling sound volume, and the like.

In this embodiment, a first user input unit 371 for playing or stopping a multimedia file or receiving a call may be of the button type for inputting a signal by pushing, and a second user input unit 372 for controlling the sound volume may be of the slide type for inputting a signal through sliding.

In addition to the upper housing 321 and the lower housing 322, a holder housing 3251 corresponding to the ear bud holder 325 coupled to the ear bud 341 may be further provided. The holder housing 3251 has a concave shape like a bowl, and is thus closed on one side and open on the other side. The ear bud 341 may be inserted into the holder housing 3251 through the open end of the holder housing 3251 and accommodated in the body.

FIG. 4 is a cross-sectional view showing an ear bud 341 coupled to an ear bud holder 325 of a portable sound apparatus 300 according to an embodiment of the present invention, taken along line A-A of FIG. 2. FIG. 5 is a cross-sectional view showing arrangement of a first magnet 3253 of the ear bud holder 325 of the portable sound apparatus 300 according to the embodiment of the present invention, taken along line B-B of FIG. 2, and FIG. 6 is a cross-sectional view showing arrangement of a second magnet 3413 of the ear bud 341 of the portable sound apparatus according to the embodiment of the present invention, taken along line C-C of FIG. 2.

To fix the holder housing 3251 so as not to be separated from the housing 320, a first engagement protrusion 3202 protruding from the inner surface of the housing 320 and a second engagement protrusion 3252 caught by the first engagement protrusion 3202 to fix the holder housing 3251 so as not to be separated from the housing 320 may be provided. The first engagement protrusion 3202 may be provided to both the upper housing 321 and the lower housing 322, and a plurality of the first engagement protrusion 3202 may be arranged along the circumference of the holder housing 3251.

The ear bud 341 includes an ear bud housing 3411 having a cylindrical shape and a receiver 3415 mounted therein. The sound output from the receiver 3415 is output through a sound hole 3412, which is located at one side of the ear bud housing 3411, and an elastic ear tip 3417 may be fitted into the sound hole 3412 as shown in FIG. 4.

The other side of the ear bud housing 3411 is closed as shown in FIG. 4. When the ear bud 341 is coupled to the ear bud holder 325, the other side may be exposed to the outside to define the exterior of the portable sound apparatus 300 together with the housing 320.

The ear tip 3417 is made of an elastic material and serves to fix the ear bud 341 to the user's ear when the ear tip 3417 is inserted into the user's ear. The ear tip 3417 is replaceable and thus may be replaced to match the user's ear size or may be replaced when contaminated. Although the ear tip 3417 is replaceable, in order to minimize contamination of the ear tip 3417, the ear bud 341 of the present invention is arranged such that the ear tip 3417 is completely drawn into the ear bud holder 325, and the other end of the ear bud housing 3411 covers the mouth portion of the ear bud holder 325 and is exposed to the outside, as shown in FIG. 4.

The conventional ear bud 341 is coupled to the ear bud holder 325 such that the ear tip 3417 is exposed to the outside. In this case, however, the ear tip 3417 tends to gather foreign matter such as dust. Therefore, in the present invention, the ear tip 3417 is coupled so as to be inserted into the ear bud holder 325.

In conventional cases, since the other side of the ear bud housing 3411 is inserted into the ear bud holder 325, the first magnet 3253 is disposed on the innermost side of the ear bud holder 325, and the second magnet 3413 having an opposite polarity to the first magnet 3253 is disposed on the other side surface of the ear bud housing 3411. However, since the present invention has the ear tip 3417 disposed inside the ear bud holder 325, the magnets cannot be disposed at the conventional position. Therefore, the first magnet 3253 of the present invention may be disposed at a portion adjacent to the opening of the holder housing 3251 as shown in FIG. 4.

The second magnet 3413 may be positioned inside the ear bud holder 325 as shown in FIG. 4(*a*), or may be disposed at a portion positioned outside the ear bud holder 325 as shown in FIG. 4(*b*). In the former case (see FIG. 4(*a*)), the second magnet 3413 is arranged to have a large area facing the first magnet 3253, and therefore an excellent coupling force may be obtained. However, the size of the ear bud holder 325 may be significantly increased. Thereby, the size of the housing 320 may be increased.

On the other hand, in the case where the second magnet is exposed to the outside of the ear bud holder 325 (see FIG. 4(*b*)), the size of the housing 320 may be reduced, but the ear bud 341 may be easily detached from the ear bud holder 325 because the magnetic force between the second magnet 3213 and the first magnet 3253 is weak.

However, it would be better to provide multiple first magnets 3253. In this case, however, the volume of the housing 320 is increased. Accordingly, a pair of the first magnets 3253 may be provided as shown in FIG. 5(*a*), or only one first magnet 3253 may be provided as shown in FIG. 5(*b*). As shown in FIG. 5, the first magnets 3253 may be arranged in the vertical direction rather than in the transverse direction in order to enhance coupling between the ear bud 341 and the ear bud holder 325 with the size of the housing 320 increased as little as possible.

When the user wears the portable sound apparatus 300, the upper surface of the housing 320 is exposed. Accordingly, increasing the vertical thickness rather than the transverse width may make the portable sound apparatus appear to have a smaller volume than in reality. Therefore, the first magnets 3253 may be arranged in the vertical direction rather than in the transverse direction as shown in FIG. 5(*a*) or may be arranged only at the lower side as shown in FIG. 5(*b*).

When only one first magnet 3253 is provided, the first magnet 3253 is positioned at the lower side. This is because the ear bud 341 is biased to the lower side due to gravity, and thus positioning the first magnet 3253 at the lower side rather than the upper side may further facilitate coupling with the second magnet 3413.

Referring to FIG. 5, in the case where the corners of the housing 320 in a cross section of the housing 320 protrude a little more than the circular shape of the ear bud holder 325 to form a square shape with rounded corners, the portion where the magnets are mounted is relatively flat and the space for mounting the user input units located at the left and right portions of the housing 320 is flat. Accordingly, it is easy to secure the mounting space of the user input units, and it is also convenient for the user to press the user input units.

Since the ear bud 341 is inserted into the ear of the user, it may be inconvenient to wear if it is angled. Thus, the ear bud 341 may be provided with a cylindrical ear bud housing 3411 having a circular cross section as shown in FIG. 6. The second magnet 3413 may be coupled to the inner surface of the ear bud housing 3411 so as to be coupled with the first magnet 3253. However, since the periphery of the ear bud housing 3411 has a curved surface, arranging the second magnet 3413 having a rectangular parallelepiped shape may reduce the thickness e2 of the second magnet 3413 and increase the spacing distance d2 from the outer surface of the ear bud 341, as shown in FIG. 6(*b*).

Therefore, as shown in FIG. 6(*a*), the corner portion of the surface of the second magnet 3413 that contacts the ear bud housing 3411 is cut to form a gentle angle such that the thickness e1 of the second magnet 3413 is increased and the distance d1 to the second magnet 3413 is reduced. Thereby, coupling between the first magnet 3253 and the second magnet 3413 may be enhanced.

The second magnet 3413 has an opposite polarity to the first magnet 3253 because it is coupled by the magnetism of the first magnet 3253. For example, if the first magnet 3253 has N polarity, the second magnet 3413 may have S polarity. If the first magnet 3253 has S polarity, the second magnet 3413 may have N polarity.

FIG. 7 is a table for describing operations that occur when the ear bud 341 is coupled to the ear bud holder 325 according to polarities of the first magnet 3253 and the second magnet 3413. FIG. 7(*a*) illustrates a case where the number of the first magnets 3253 is two as shown in FIG. 5(*a*) and FIG. 7(*b*) illustrates a case where the number of the first magnets 3253 is one as shown in FIG. 5(*b*).

When the pair of first magnets 3253 has different polarities, the second magnets 3413 also employ magnets of different polarities. In this case, when the first magnets 3253 having N polarity and the second magnets 3413 having S polarity are arranged adjacent to each other, the ear bud 341 is coupled to the ear bud holder 325. If the ear bud 341 is coupled to the ear bud holder 325 in the 180° opposite direction, the ear bud 341 is pushed out from the ear bud holder 325. That is, coupling is allowed only in the normal direction.

If the pair of first magnets 3253 has the same polarity (for example, N polarity) and the pair of second magnets 3413 has the same polarity (for example, S polarity), the ear bud 341 is coupled to the ear bud holder 325 in the normal direction, or in the 180° reversed direction.

In conventional cases, only one magnet is provided on the opposite side of the sound hole 3412 of the ear bud 341. In contrast, the ear bud 341 of the portable sound apparatus 300 according to the present invention is provided with two magnets and thus has directionality. When the ear bud 341 is inserted into the ear bud holder 325 in the direction slightly deviated from the normal direction (e.g., in a 45° oblique direction), the ear bud 341 is rotated and arranged in the normal direction by the polarities.

In the case where two second magnets 3413 are provided, a similar effect may be obtained even if only one first magnet 3253 is provided. As shown in FIG. 7(*b*), when the pair of second magnets 3413 has different polarities, the first magnet 3253 pulls only a second magnet 3413 having the opposite polarity between the second magnets 3413. Therefore, if coupling is performed in the normal direction, the ear bud 341 is coupled to the ear bud holder 325. However, if the coupling is performed in the 180° reversed direction, the ear bud 341 will be pushed out of the ear bud holder 325. That is, coupling is allowed only in the normal direction.

When the second magnets 3413 have the same polarity, the first magnet 3253 can be coupled to both second magnets 3413, and therefore the ear bud 341 is coupled to the ear bud holder 325 even if the coupling is performed in the 180° reversed direction. That is, regardless of whether the number of the first magnets 3253 is one or two, the ear bud 341 may be coupled to the ear bud holder 325 in a similar manner.

Figure 9:
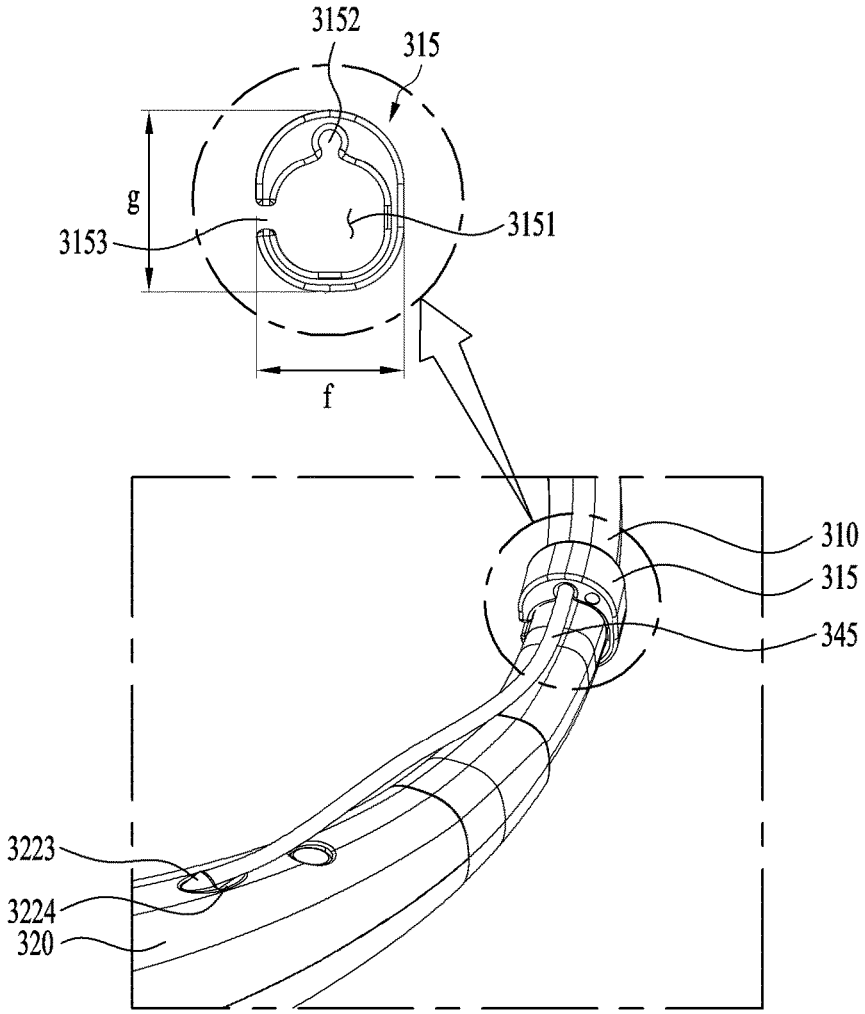
FIG. 9 is a view showing a sound cable coupled to a housing of a portable sound apparatus of the present invention.
Figure 10:
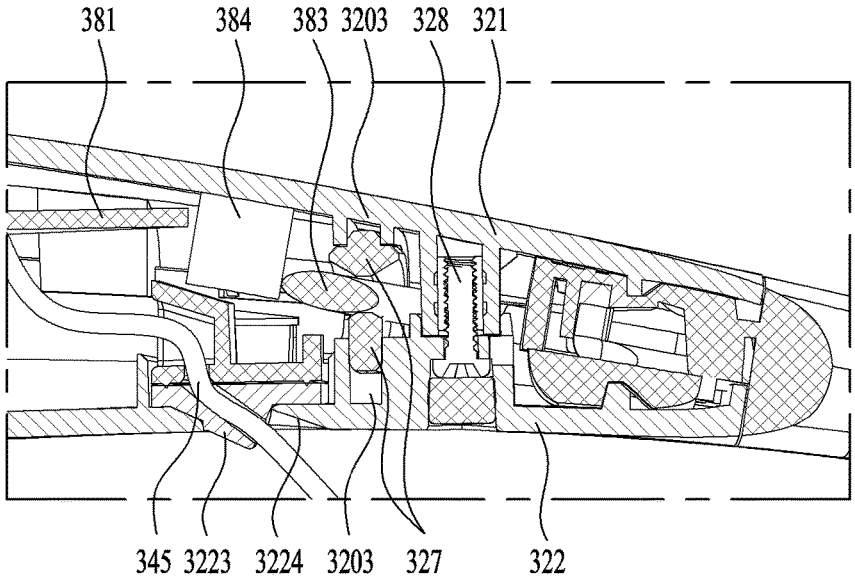
FIG. 10 is a cross-sectional view taken along line D-D of FIG. 2.

FIG. 8 is a view illustrating coupling between the ear bud 341 and the ear bud holder 325 according to the present invention and the related art. FIG. 9 is a view showing a sound cable 345 coupled to the housing 320 of the portable sound apparatus 300 of the present invention. FIG. 10 is a cross-sectional view taken along line D-D of FIG. 2.

One end of the sound cable 345 is coupled to the ear bud 341 and the other end is connected to the housing 320 of the body. That is, the ear bud 341 is electrically connected to the main board 381 positioned inside the housing 320 via the sound cable 345, and thus receives a sound signal received through the wireless communication unit and outputs sound.

FIG. 8(*a*) shows a portable sound apparatus 300 of the present invention, and FIG. 8(*b*) shows a conventional portable sound apparatus 300. As shown in FIG. 8(*b*), one end of the conventional sound cable 345 is connected to a side (the other side) of the ear bud 341 opposite to a side (one side) of the ear bud 341 at which the sound hole 3412 of the ear bud 341 is formed, and the other end of the sound cable 345 is connected to the transverse side of the exterior of the housing 320. Since the conventional ear bud holder 325 is partially open, the sound cable 345 may extend toward the other side of the ear bud 341.

On the other hand, in the present invention, one side of the ear bud 341 to which the ear tip 3417 is attached is inserted into the ear bud holder 325 as shown in FIG. 8 (*a*). Accordingly, when the other side of the ear bud 341 is exposed to the outside when the ear bud 341 is coupled to the ear bud holder 325. If a portion of the ear bud 341 connected to the sound cable 345 is located on the upper side of the housing 320, poor appearance may be formed in terms of aesthetics. If the portion is located on the lower side, it may contact the body of the user and thus the ear bud 341 may be separated from the ear bud holder 325.

Accordingly, since the magnet is located on at least one of the upper side and the lower side of the housing 320 as described above, one end of the sound cable 345 is coupled in a direction vertical to the direction of arrangement of the magnet such that the sound cable 345 is positioned on the transverse side of the exterior of the housing 320, as shown in FIG. 2.

To prevent the sound cable 345 from being caught, a cable clip 315 for fixing a portion of the sound cable 345 between one end and the other end of the sound cable 345 to the body may be further provided. As shown in FIG. 9, the cable clip 315 is coupled to the band part 310 and moves along the band part 310 to fix the sound cable 345 in a manner that the sound cable 345 is in close contact with the body, thereby preventing the sound cable 345 from being caught by a hand or clothing to ensure that the ear bud 341 is not separated from the ear bud holder 325.

As shown in FIG. 8(*b*), when the other end of the sound cable 345 is coupled to the transverse side of the housing 320, a portion of the sound cable 345 between a portion of the sound cable 345 coupled to the housing 320 and a portion of the sound cable 345 fixed by the cable clip may be loose and thus be caught by an object. To address this issue, the sound cable 345 of the present invention is coupled to the lower surface of the housing 320 as shown in FIGS. 9 and 10.

In the case where the sound cable is coupled to the lower surface of the housing 320, in order to prevent the user's body from contacting the coupling portion, which causes inconvenience, a groove having an inclined surface 3224 is formed on the lower surface of the housing 320 such that the sound cable 345 extends along the groove. Thereby, the other end of the sound cable 345 is prevented from protruding from the housing 320 when coupled to the housing 320.

To fix the other end of the sound cable 345 such that the sound cable 345 is disposed along the inclined surface 3224, the sound cable 345 is fixed to the housing 325 using a cable rubber member 3223 as shown in FIG. 10. The cable rubber member 3223 is formed of an elastic material and thus the shape thereof is deformable so as to prevent the sound cable 345 from being cut off when the sound cable 345 is pulled. The cable rubber member 3223 also closely contacts the sound cable 345 and the housing 320, thereby preventing water from infiltrating through the coupling portion of the sound cable 345 and the housing 320.

Referring to FIG. 9, the cable clip 315 is formed in a ring shape to surround the band part 310 and the sound cable 345, and includes a first fixing portion 3151 in which the band part 310 is positioned, and a second fixing portion 3152 in which the sound cable 345 is positioned. The first fixing portion 3151 and the second fixing portion 3152 are arranged in a snowman shape (or an 8-shape). The first fixing portion 3151 corresponds to the cross section of the band part 310 and the second fixing portion 3152 has a shape corresponding to the cross section of the sound cable 345.

The housing 320 of the present invention may have a rectangular shape with rounded corners as described above, and the band part 310 may have a rectangular cross section with rounded corners in consideration of the shape of the housing 320 and unity. The first fixing portion 3151 may also have a rectangular ring shape with rounded corners like the cross section of the band part 310 and the cable clip 315 does not easily rotate about the band part 310. Therefore, the width f of the cable clip 315 in the transverse direction is less than the width g in the vertical direction, and thus when the user wears the portable sound apparatus 300 of the present invention, the portable sound apparatus 300 may look smaller than the actual size thereof.

If the cable clip 315 is not detached from the band part 310, the portable sound apparatus 300 may be disconnected from the user's neck, or the sound cable 345 may be disconnected. To address this issue, the cable clip 315 may move in the longitudinal direction of the band part 310 and, when the sound cable 345 is pulled with a force greater than a certain force, the cable clip 315 may be separated from the band part 310.

As shown in FIG. 9, the cable clip 315 is open on one side. Since the sound cable 345 is pulled out away from the body of the user, an opening 3153 may be formed on the inner side of the cable clip 315, such that that the cable clip 315 has a C-shape.

In particular, referring to FIG. 9, when the opening 3153 and the second fixing portion 3152 of the cable clip 315 are arranged to face in directions perpendicular to each other, the cable clip 315 may be prevented from being easily separated from the body. If the opening 3153 of the cable clip 315 and the second fixing portion 3152 by which the sound cable 345 is fixed are arranged in a line (to face each other), the band part 310 may be separated from the sound cable 345 even by slightly pulling the sound cable 345. To prevent the cable clip 315 from being easily separated from the band part 310, the opening 3153 is disposed in a direction perpendicular to the direction in which the second fixing portion 3152 faces.

Since the band part 310 includes an elastic material and the housing 320 includes a rigid material, a bracket 330 for connecting the band part 310 and the housing 320 may be further provided. While the conventional portable sound apparatus 300 connects the band part 310 and the housing 320 by combining a plurality of pieces of the bracket 330 together, the portable sound apparatus 300 according to the present invention uses a bracket 330 formed by one piece.

Since one bracket 330 is used, the number of parts and assembly processes may be reduced. Accordingly, manufacturing costs may be reduced, and defects due to tolerances between the parts may be reduced. FIG. 11 shows a bracket 330 of a portable sound apparatus 300 of the present invention. The bracket 330 is divided into a first portion 331 exposed to the outside and a second portion 335 located inside the housing 320. The first portion 331 may include a hole 332 through which a signal line 383 for transmitting or receiving a signal or power between components inside the housing 320 located on the left and right passes, and the second portion 335 includes an empty space 336 in which the signal line 383 is positioned. Since the second portion 335 is covered by the housing 320, it has an open lower portion as shown in FIG. 11(*b*) and a closed upper portion as shown in FIG. 11(*a*).

The second portion 335 further includes a third portion 338 extending to one side of the screw 328 that couples the upper housing 321 and the lower housing 322, and a portion 337 on the side opposing to the screw 328 is open to allow the signal line 383 to pass therethrough. As the third portion 338 of the bracket 330 is positioned on one side of the screw 328 and the signal line 383 is positioned on the other side of the screw 328, coupling between the bracket 330 and the housing 320 may be enhanced.

FIG. 12 illustrates coupling between the bracket 330 and the housing 320 of the portable sound apparatus 300 of the present invention. When a force is applied to the body to change the shape of the band part 310, a gap may be formed between the bracket 330 and the housing 320. Thereby, the user's hair or the like may be caught in the gap between the bracket 330 and the housing 320.

The present invention may further include a slide guide 339 and a slide hook 323 to enhance coupling between the bracket 330 and the housing 320. The slide guides 339 are formed on the right and left sides of the second portion 335 of the bracket 330. When the housing 320 is coupled in a direction shown in FIG. 12(*a*), the sliding hook 323 formed on the inner side surface of the housing 320 is engaged with the slide guides 339, and the housing 320 and the bracket 330 are slidably engaged.

FIG. 12(*b*) is a sectional view taken along line E-E of FIG. 2. The slide hook 323 of the housing 320 is positioned between the slide rails of the bracket 330, which prevents a gap from being created between the housing 320 and the bracket 330 when a force for vertically bending the housing 320 is applied.

Figure 13:
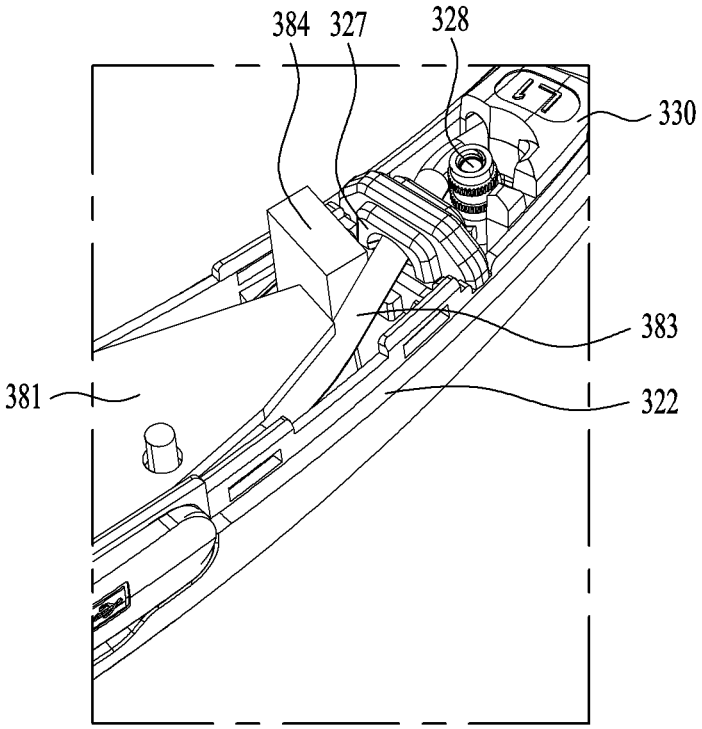
FIG. 13 is a view showing a waterproof ring fitted onto a signal line in a housing of a portable sound apparatus of the present invention.

FIG. 13 is a view showing a waterproof ring 327 fitted onto the signal line 383 in the housing 320 of the portable sound apparatus 300 of the present invention. The upper portion (near the band) of the waterproof ring 327 is open for engagement with the bracket 330, and is provided with a hole for coupling with the screw 328. Accordingly, external moisture may be introduced into the housing. The waterproof ring 327 for partitioning the inside of the housing 320 as shown in FIG. 13 may be further provided to prevent the moisture introduced into the housing 320 from affecting the main components such as the main board 381. The waterproof ring 327 may be provided with an opening at the center thereof to allow the signal line 383 to pass therethrough and a groove for fixing the waterproof ring to partition the housing 320.

In order to prevent the signal line 383 of the present invention from moving inside the housing 320 to make a sound or to cause faulty connection between the signal line 383 and the main substrate 381, a foam structure 384 for fixing the signal line 383 to the housing 320 may be further provided. The foam structure 384 may be fixed to the vertical sides of the housing 320 as shown in FIG. 10, and is fixed between the signal line 383 and the housing 320 in the transverse direction as shown in FIG. 13. Accordingly, the signal line 383 may be stably positioned inside the housing 320.

Figure 14:
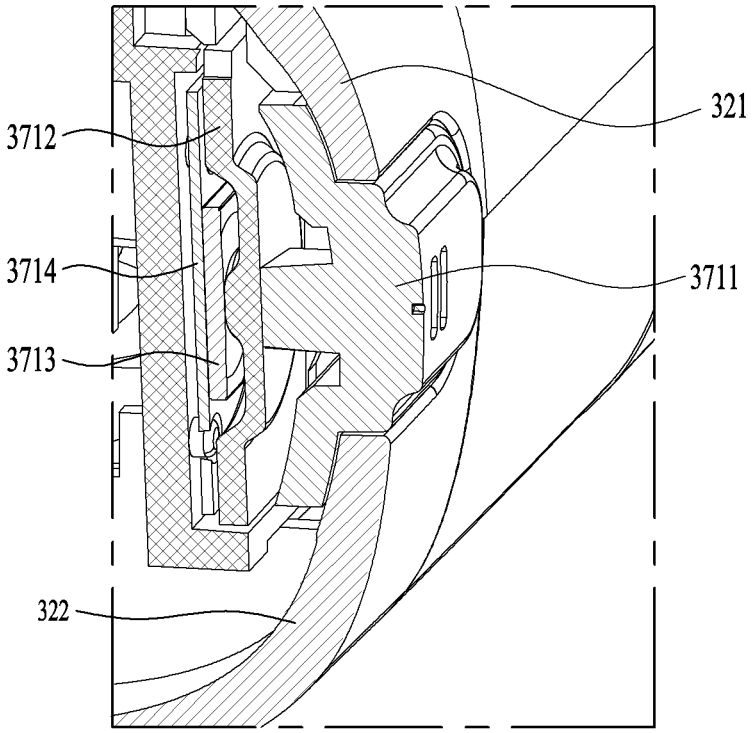
FIG. 14 is a cross-sectional view showing the cross section of a button positioned in a housing of a portable sound apparatus of the present invention, taken along line F-F of FIG. 2.

FIG. 14 is a cross-sectional view showing the cross section of a button 371 positioned in the housing 320 of the portable sound apparatus 300 of the present invention, taken along line F-F of FIG. 2. The button 371 includes a top button 3711 exposed to the outside of the housing 320, a dome switch 3713 for generating a signal when the top button 3711 is pressed, and a flexible substrate 3714 for transmitting the signal generated from the dome switch 3713 to the main board 381. If water is introduced through the button hole formed in the housing 320 to allow the top button 3711 to be exposed to the outside of the housing 320, it may damage the electronic components such as the main board 381 inside the housing 320. In order to prevent such damage, an elastic button 3712 having a waterproof function may be interposed between the top button 3711 and the dome switch 3713 as shown in FIG. 14.

Since the portable sound apparatus 300 according to the present invention may be carried without the ear tip 3417 being exposed to the outside, the ear tip 3417 may not be contaminated.

In addition, since a portion of the sound cable 345 between the housing 320 and the cable clip 315 is in close contact with the body, it may not be caught by the sound cable 345.

The foregoing detailed description is to be regarded as illustrative rather than restrictive in every respect. The scope of the present invention should be determined by rational interpretation of the appended claims, and all changes within the equivalence range of the present invention within the scope of the present invention.

What is claimed is:

1. A portable sound apparatus comprising:
- a body configurable to be worn on a user's body;
- an ear bud holder located at the body, the ear bud holder having an open end spaced from the body and a closed end adjacent the body opposite the open end, the ear bud holder including at least one first magnet located in the ear bud holder; and
- an ear bud configured to have a first end inserted into the ear bud holder and a second end exposed through the opening of the ear bud holder, the ear bud including:
  - an ear bud housing having a sound hole at the first end of the ear bud;
  - an ear tip coupled to the sound hole and positioned within the ear bud holder when the first end of the ear bud is inserted into the ear bud holder;
  - a receiver positioned inside the ear bud housing and configured to output sound through the sound hole; and
  - a second magnet having an opposite polarity to a polarity of the at least one first magnet,
- wherein the ear bud housing has a cylindrical shape, and
- wherein corners of the second magnet facing an inner surface of the ear bud housing are chamfered.

2. The portable sound apparatus according to claim 1, wherein the at least one first magnet is a single magnet positioned at a lower side of the ear bud holder when the body is worn by the user.

3. The portable sound apparatus according to claim 2, wherein the single magnet is located at a periphery of the open end of the ear bud holder.

4. The portable sound apparatus according to claim 3, wherein the second magnet is located closer to the second end than to the first end of the ear bud.

5. The portable sound apparatus according to claim 1, wherein the at least one first magnet is two magnets positioned on an upper side and a lower side, respectively, of the ear bud holder when the body is worn by the user.

6. The portable sound apparatus according to claim 5, wherein the two magnets are located at a periphery of the open end of the ear bud holder.

7. The portable sound apparatus according to claim 6, wherein the ear bud holder is positioned at an end of the body, and wherein a cross-section of the body at the end of the body is longer in a vertical direction than in a transverse direction when the body is worn by the user.

8. The portable sound apparatus according to claim 1, wherein the ear bud holder is positioned at an end of the body, and wherein a cross section of the body at the end of the body is longer in a vertical direction than in a transverse direction when the body is worn by the user.

9. A portable sound apparatus comprising:

a body configurable to be worn on a user's body;

an ear bud holder located at the body, the ear bud holder having an open end spaced from the body and a closed end adjacent the body opposite the open end, the ear bud holder including at least one first magnet located in the ear bud holder;

an ear bud configured to have a first end inserted into the ear bud holder and a second end exposed through the opening of the ear bud holder; and a sound cable having a first end connected to the second end of the ear bud and a second end connected to the body, wherein the ear bud includes:

an ear bud housing having a sound hole at the first end of the ear bud;

an ear tip coupled to the sound hole and positioned within the ear bud holder when the first end of the ear bud is inserted into the ear bud holder;

a receiver positioned inside the ear bud housing and configured to output sound through the sound hole; and a second magnet having an opposite polarity to a polarity of the at least one first magnet.

10. The portable sound apparatus according to claim 9, wherein the body is wearable on the user's neck and has a first face oriented toward the user's body, and wherein the second end of the sound cable is connected to the first face of the body.

11. The portable sound apparatus according to claim 10, wherein the sound cable is disposed in a direction perpendicular to the second magnet.

12. The portable sound apparatus according to claim 10, wherein the body includes a groove having an inclined surface formed in the first face of the body, and wherein the second end of the sound cable is positioned in the groove and extends along the inclined surface.

13. The portable sound apparatus according to claim 10, further comprising a cable clip coupled between the first end and the second end of the sound cable and configured to fix the sound cable to the body.

14. The portable sound apparatus according to claim 13, wherein the body has a rectangular cross section with rounded corners, and wherein the cable clip includes a first fixing portion configured to surround the body and having a ring shape corresponding to the cross section of the body.

15. The portable sound apparatus according to claim 14, wherein the cable clip includes a second fixing portion opening into the first ring toward the first face of the body, the sound cable extending through the second fixing portion.

16. The portable sound apparatus according to claim 15, wherein the first fixing portion has a C-shape that is open in a direction perpendicular to a direction in which the second fixing portion is formed.

17. The portable sound apparatus according to claim 13, wherein the body includes:

a band part configured to be positioned behind the user's neck; and a pair of housings provided at opposites ends of the band part, wherein the sound cable is provided in plurality, and the second end of each sound cable is coupled to a respective one of the housings, and wherein the cable clip is provided in plurality, and each of the cable clips is provided adjacent the respective one of the housings.

18. The portable sound apparatus according to claim 1, wherein the body comprises:

a band part configured to be positioned behind the user's neck, the band part having an end;

a bracket coupled to the end of the band part;

a slide guide protruding at the bracket; and a housing comprising a slide hook contacting the slide guide, and wherein the housing is slidably coupled to the bracket.

19. The portable sound apparatus according to claim 18, further comprising:

a signal line having an end extending from the band part, the end extending into the housing; and a waterproof ring positioned inside the housing and configured to surround an outer circumference of the signal line.

* * * * *